US007733025B2

(12) United States Patent
Park

(10) Patent No.: US 7,733,025 B2
(45) Date of Patent: Jun. 8, 2010

(54) PLASMA DISPLAY PANEL

(75) Inventor: Yu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 788 days.

(21) Appl. No.: 11/289,419

(22) Filed: Nov. 30, 2005

(65) Prior Publication Data

US 2006/0132010 A1 Jun. 22, 2006

(30) Foreign Application Priority Data

Dec. 1, 2004 (KR) ..... 10-2004-100063
Dec. 1, 2004 (KR) ..... 10-2004-100064
Dec. 1, 2004 (KR) ..... 10-2004-100065

(51) Int. Cl.
*H01J 17/49* (2006.01)

(52) U.S. Cl. ..... 313/587; 313/582

(58) Field of Classification Search ..... 313/582–587; 315/169.4; 345/37, 41, 60
See application file for complete search history.

(56) References Cited

U.S. PATENT DOCUMENTS 6,104,530 A * 8/2000 Okamura et al. ..... 359/359
6,316,110 B1 * 11/2001 Anzaki et al. ..... 428/432
6,429,587 B1 * 8/2002 Sugimachi et al. ..... 313/582
6,447,909 B1 * 9/2002 Kato et al. ..... 428/403
6,545,412 B1 * 4/2003 Jang ..... 313/587

FOREIGN PATENT DOCUMENTS

| | | | |
|---|---|---|---|
| CN | 1369899 | A | 9/2002 |
| JP | 11-20076 | A | 1/1999 |
| JP | 2004-313465 | A | 11/2004 |
| KR | 102002-0096536 | A | 12/2002 |
| KR | 102003-0038883 | A | 5/2003 |
| KR | 10-2004-0072422 | A | 8/2004 |
| KR | 10-2004-0072423 | A | 8/2004 |
| KR | 10-2004-0074298 | A | 8/2004 |
| KR | 102004-0072376 | A | 8/2004 |
| KR | 102004-0085699 | A | 10/2004 |

* cited by examiner

*Primary Examiner*—Nimeshkumar D. Patel
*Assistant Examiner*—Christopher M Raabe
(74) *Attorney, Agent, or Firm*—Birch, Stewart, Kolasch & Birch, LLP

(57) ABSTRACT

A plasma display panel (PDP) is disclosed in which a film type filter is coupled with a panel. The PDP includes the panel, a transparent conductive film and a metal film formed on the transparent conductive film, and further includes the film type filter coupled with the panel. Accordingly, electromagnetic waves can be effectively shielded and the optical transmittance of the filter can be improved.

6 Claims, 7 Drawing Sheets

PLASMA DISPLAY PANEL

BACKGROUND OF THE INVENTION

1. Field of the Invention

The present invention relates to a plasma display panel (PDP) and, more particularly, to a PDP in which a film type filter is coupled with a panel.

2. Description of the Related Art

A PDP is constructed such that discharge cells are formed between a lower substrate with barrier ribs formed thereon and an upper substrate facing the lower substrate, and when an inert gas inside each discharge cell is discharged by a high frequency voltage, vacuum ultraviolet rays are generated to illuminate phosphor to thereby allow displaying of images.

FIG. 1 is a perspective view showing the structure of a related art PDP.

With reference to FIG. 1, in the related art PDP, a scan electrode (Y) and a sustain electrode (Z) are formed on an upper substrate 10, and an address electrode (X) is formed on a lower substrate 18 which faces the upper substrate 10.

The scan electrode (Y) and the sustain electrode (Z) includes a transparent electrodes 12Y and 12Z and metal bus electrodes 13Y and 13Z formed on one edge portion of the transparent electrodes 12Y and 12Z and having a smaller line width than that of the transparent electrodes 12Y and 12Z, respectively.

The transparent electrodes 12Y and 12Z are formed typically with an indium tin oxide (ITO) material on the upper substrate 10. The metal bus electrodes 13Y and 13Z are formed typically with a metal such as chrome (Cr) on the transparent electrodes 12Y and 12Z, respectively, and serve to reduce a voltage drop by the transparent electrodes 12Y and 12Z.

A dielectric layer 14 and a protective film 16 are sequentially stacked to cover the scan electrode (Y) and the sustain electrode (Z) on the upper substrate. Wall charges generated during a plasma discharge are accumulated in the upper dielectric layer 14. The protective film 16 prevents a damage of the dielectric layer 14 and improves the emission efficiency of secondary electrons. The protective film 16 is typically made of magnesium oxide (MgO).

A lower dielectric layer 22 and barrier ribs 24 are formed on the lower substrate 18 on which the address electrode (X) has been formed, and phosphor 26 is coated on the surface of the lower dielectric layer 22 and the barrier ribs 24.

The phosphor layer 26 is excited by ultraviolet rays generated during the plasma discharge to generate one of red, green and blue visible light, and an inert mixture gas is injected into a discharge space formed between the upper substrate 10 and the barrier ribs 24 of the lower substrate 18.

The panel formed by coupling the upper substrate 10 and the lower substrate 18 is a load having enormous capacitance, and when a high voltage driving pulse is applied to the panel capacitor, electromagnetic waves radiate to a front surface thereof. Thus, in order to block the electromagnetic waves, a filter 30 is coupled on the front surface of the panel.

FIG. 2 is a sectional view showing one side of the related art PDP. With reference to FIG. 2, the related art PDP includes a panel 32, a filter 30 coupled to the panel 32, a heat sink plate 34, a PCB (Printed Circuit Board) 36, a back cover 38, a filter supporter 40, and a support member 42.

The panel 32 is formed as the upper substrate 10 and the lower substrate 18 are attached. The filter 30 is installed on the front surface of the panel 32 and the heat sink plate 34 is installed on a rear surface of the panel 32 to sink heat generated from the panel 32 and the PCB 36.

The PCB 36 is attached on the heat sink plate 34 and supplies a drive pulse to the electrodes of the panel 32. The back cover 38 forms an outer appearance of the rear surface of the panel 32 and blocks electromagnetic waves discharged to the rear surface of the panel 32.

The filter supporter 40 connects the filter 30 and the back cover 38 to make the filter 30 grounded, and the support member 42 is installed between the filter 30 and the back cover 38 and covers the filter supporter 40.

FIG. 3 shows the structure of the filter 30 coupled with the panel 32.

With reference to FIG. 3, the related art filter 30 is formed by stacking an antireflection coating film 50, a optical characteristic film 52, glass 54, an electromagnetic interference (EMI) shielding film 56, and a near infrared (NIR) shielding film 58. Though not shown, an attachment layer is formed between respective films to attach the films to each other.

The antireflection coating film 50 prevents reflection of incident light to thereby enhance a optical and shade ratio of the panel 32, and the optical characteristic film 52 controls color temperature of light radiated by the panel 32 to thereby improve optical characteristics of the PDP.

The glass 54 prevents the filter 30 from being damaged by an external impact, and the EMI shielding film 56 prevents EMI made to the front surface of optical the panel 32.

However, the thusly constructed filter 30 of the related art has a problem in that since it includes the glass 54, the weight and thickness of the filter are increased to accordingly increase a fabrication cost.

In addition, the EMI shielding film 56 is made of a transparent conductive metal, so in this case, a metal film needs to be additionally formed to compensate resistance characteristics of the transparent conductive metal. This results in that optical transmittance of the panel is degraded due to the metal film and the fabrication cost of the panel is increased due to the stacking of the metal film.

SUMMARY OF THE INVENTION

The present invention is designed to solve such problem of the related art, and therefore, an object of the present invention is to provide plasma display panel (PDP) that can be formed to be light and thin and effectively shield electromagnetic waves.

To achieve the above object, there is provided a plasma display panel (PDP) comprising a panel and a film type filter coupled with the panel. The filter includes a transparent conductive film and a metal film formed on the transparent conductive film.

The filter, as the film type filter, further includes an antireflection coating film stacked on the panel, a optical characteristic film for controlling color temperature of light, and a near infrared (NIR) shielding film.

The transparent conductive film includes an indium tin oxide (ITO) material and may be formed by alternately depositing the ITO layer and a metal film.

The transparent conductive film may be formed as a mixture layer in which metal powder and transparent conductive powder are mixed, and also may be formed by alternately depositing the mixture layer and the metal film.

The metal powder of the mixture layer is at least one metal of silver (Ag), copper (Cu), gold (Au) and aluminum (Al), and the transparent conductive powder is ITO. In this case, the ratio of the metal powder may be 10% or less than the transparent conductive powder.

The metal film is formed by pattering at least one of silver (Ag), copper (Cu), gold (Au) and aluminum (Al), and overlaps with barrier ribs separating a discharge space formed within the panel.

That is, the metal film is formed at a non-display region of the panel, and in this case, the metal film is formed in a bar shape at at least one side of the non-display region or formed at the periphery of the non-display region and connected with a ground terminal.

In addition, the film type filter includes a transparent conductive film with the metal powder and the transparent conductive powder mixed therein, and further includes the antireflection coating film, the optical characteristic film and the NIR shielding film without stacking a metal film.

The thusly constructed PDP comprising the film type filter can be thinner and exhibit improved picture quality because it has relatively high optical transmittance compared with that of the related art.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
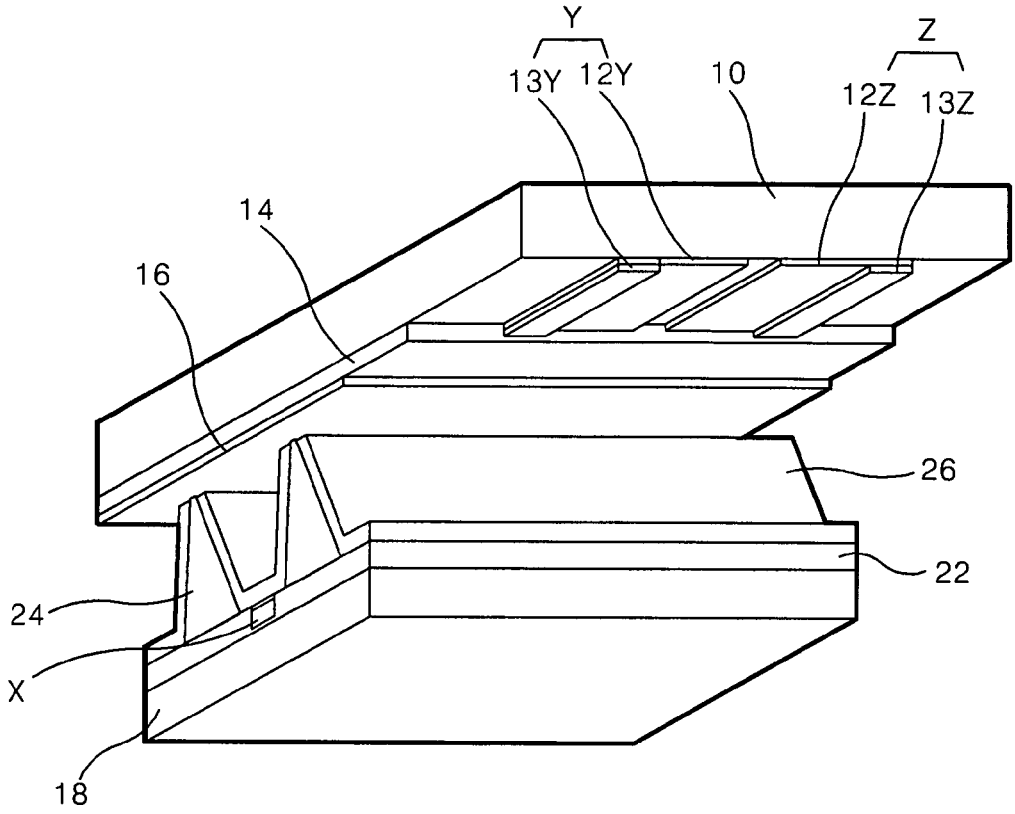
FIG. 1 (Prior Art)
FIG. 1 is a perspective view showing the structure of a general plasma display panel (PDP).
Figure 2:
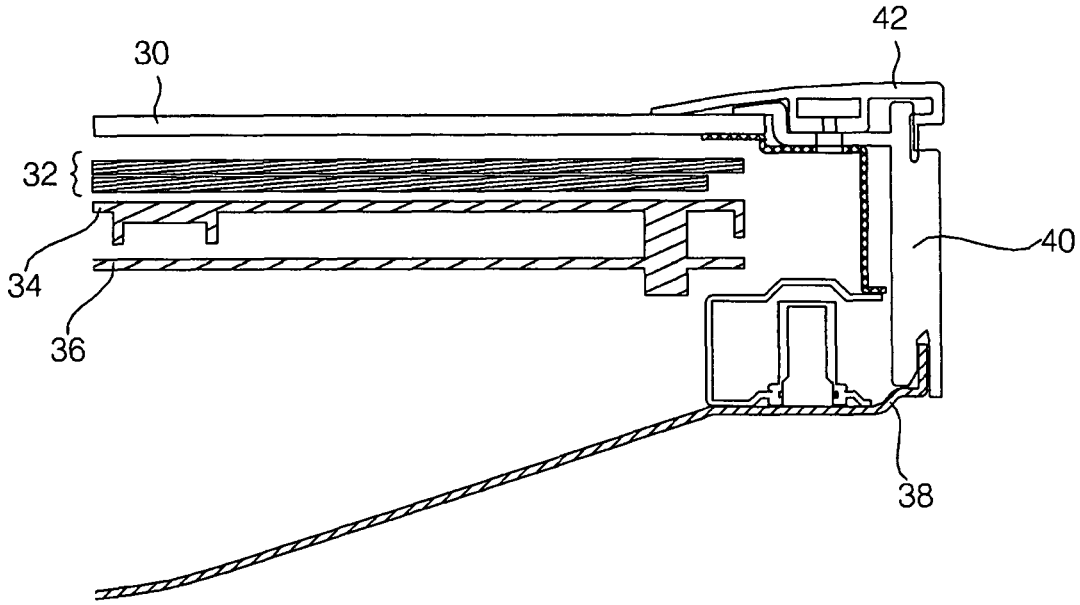
FIG. 2 (Prior Art)
FIG. 2 is a sectional view showing one side of a plasma display panel in accordance with a related art.
Figure 3:
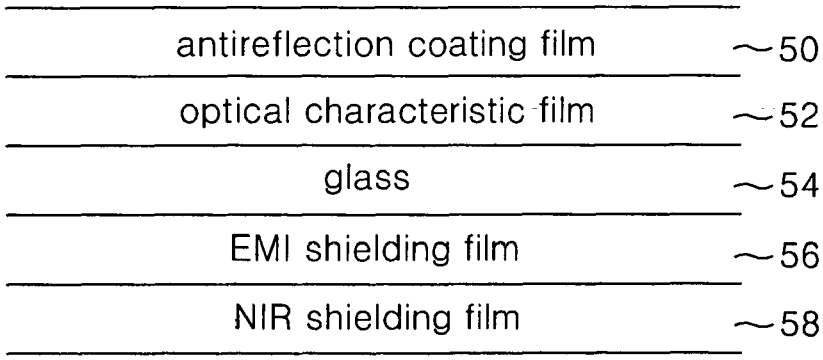
FIG. 3 (Prior Art)
FIG. 3 is a sectional view showing the structure of a filter of the PDP in accordance with the related art.

The structure of the film type filter in accordance with the present invention and a plasma display panel (PDP) comprising the filter in accordance with the embodiments of the present invention will now be described with reference to the accompanying drawings.

There can be a plurality of embodiments of the PDP in accordance with the present invention without being limited to those described in the present invention.

To begin with, the PDP in accordance with first and second embodiments of the present invention will be described with reference to FIGS. 4 to 7.

In the first and second embodiments of the present invention, filters 100 and 200 are formed as a film type, respectively, by comprising antireflection coating films 110 and 210, optical characteristic films 120 and 220, transparent conductive films 130 and 230, near infrared (NIR) shielding films 140 and 240 without glass.

Figure 4:
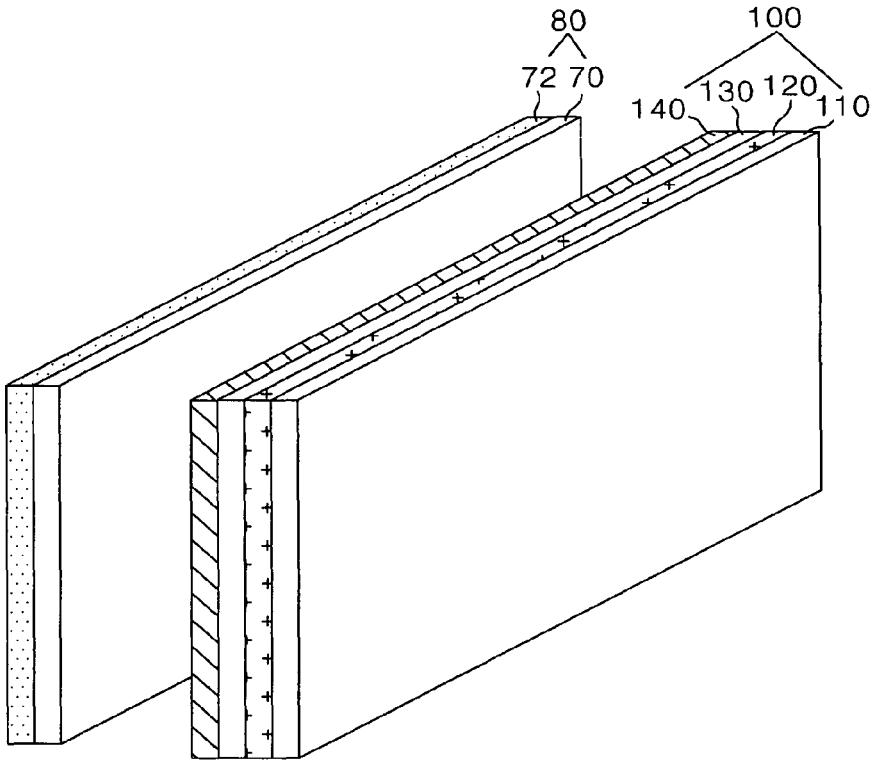
FIG. 4 is a reference view for explaining a PDP in accordance with a first embodiment of the present invention.
Figure 5:
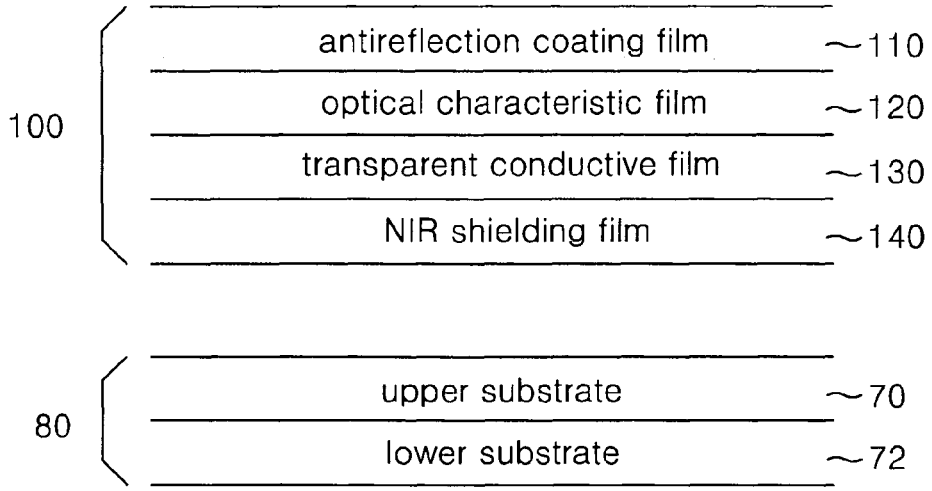
FIG. 5 is a sectional view of a filter in FIG. 4.

FIG. 4 is a perspective view illustrating the panel and the filter coupled with the panel of the PDP in accordance with the first embodiment of the present invention, and FIG. 5 is a sectional view of the filter.

With reference to FIGS. 4 and 5, the PDP in accordance with the present invention includes a panel 80 formed by attaching an upper substrate 70 and a lower substrate 72, and the film type filter 100 installed on a front surface of the panel.

The panel 80 emits light for displaying a certain image according to a driving pulse supplied from a printed circuit board (PCB) (not shown).

The filter 100 includes the antireflection coating film 110, the optical characteristic film 120, the transparent conductive film 130 and the NIR shielding film 140. Though not shown, an attachment layer is formed between respective films 110~140 to allow the films to be attached to each other. The optical characteristic film 120 is formed by inserting a specific material into the attachment layer.

The antireflection coating film 110 prevents reflection of optical made incident from outside, and is formed on a surface of the filter 100. The antireflection coating film 110 can be additionally formed on a rear surface of the filter 100.

The optical characteristic film 120 controls color temperature of light emitted from the panel 80 to thereby improve optical characteristics of the PDP.

The transparent conductive film 130 is made of a transparent conductive metal, for example, a metal such as indium tin oxide (ITO), and prevents emission of electromagnetic waves to outside from the panel 80.

The transparent conductive film 130 can be deposited by alternately coating transparent conductive metal powder and conductive metal powder for compensating resistance of the transparent conductive metal. That is, the transparent conductive film 130 can be formed as a multi-film by alternately stacking a film containing the transparent conductive metal powder and a film containing the metal powder.

In this case, as the conductive metal powder, at least one of silver (Ag), copper (Cu), gold (Au) and aluminum (Al) can be used. The ratio of the metal powder is 10% or less than the transparent conductive powder in order to obtain the contrast of the panel.

The thusly formed transparent conductive film 130 can improve optical transmittance of light emitted from the panel 80, and because of the conductive metal powder contained therein, it can shield electromagnetic waves.

The NIR shielding film 140 shields near infrared rays emitted from the panel 80. The transparent conductive film 130 and the NIR shielding film 140 can be formed as a single film. In this case, at least one of the transparent conductive film 130 and the NIR shielding film 140 is connected with a back cover so as to be grounded, thereby shielding electromagnetic waves.

Figure 6:
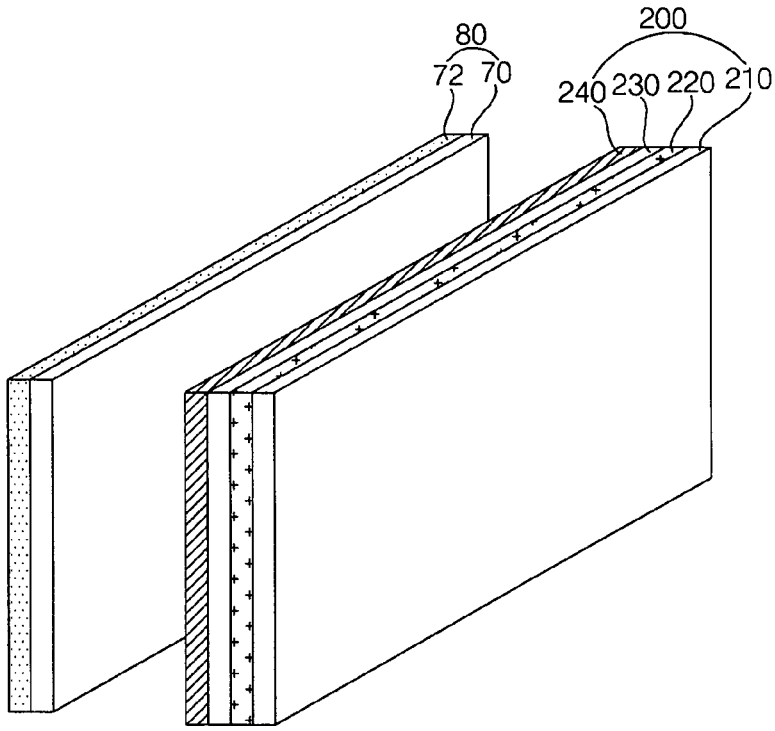
FIG. 6 is a reference view for explaining a PDP in accordance with a second embodiment of the present invention.
Figure 7:
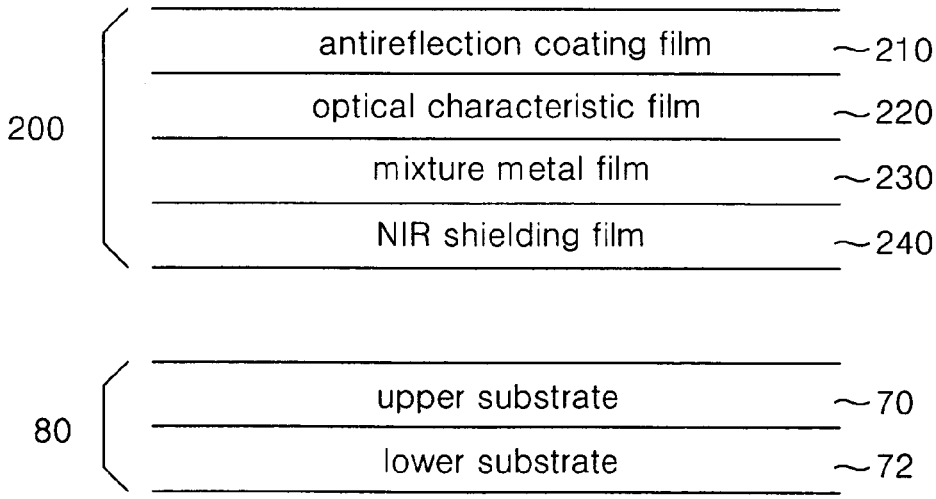
FIG. 7 is a sectional view of a filter in FIG. 6

FIG. 6 is a perspective view illustrating a panel and a filter coupled with the panel of the PDP in accordance with the second embodiment of the present invention, and FIG. 7 is a sectional view of the filter.

The panel and the filter 200 coupled with the panel of the PDP in accordance with the second embodiment of the present invention are similar to those of the PDP in accordance with the first embodiment of the present invention, so descriptions for the same part will be replaced with the descriptions of the first embodiment of the present invention.

The difference of the filter in the second embodiment from that of the first embodiment of the present invention is that the filter of the second embodiment includes a mixture metal film 230, in place of the transparent conductive film 130 in the first embodiment, which is formed as a single film by mixing transparent conductive metal powder and conductive metal powder for compensating resistance of the transparent conductive metal. Namely, because a film for shielding electromagnetic waves made incident from the panel 80 and a film for preventing a generated voltage drop are incorporatively formed as the single film, the PDP can be lighter and thinner.

As the transparent conductive metal powder, the ITO material is used, and as the conductive metal powder, at least one of silver (Ag), copper (Cu), gold (Au) and aluminum (Al) is used.

For example, the mixture metal film 230 is formed such that fine ITO metal powder, silver metal powder, an organic solvent and an organic binder are stirred to be uniformly mixed to form paste, which is then coated on the upper substrate 70 of the panel 80.

After the paste is coated with a uniform thickness on the upper substrate 70, it is subjected to a firing process in a firing temperature environment to remove the organic solvent and the organic binder, resulting in formation of the mixture metal 230 on the upper substrate 70.

Accordingly, because mostly major part of the mixture metal film 230 is the transparent conductive metal, the optical transmittance can be improved, and because the mixture metal film 230 contains the conductive metal, it can prevent a voltage drop generated according to electrical characteristics of the transparent conductive metal and shield electromagnetic waves.

In order to satisfy the 95% optical transmittance of the typical plasma display panel, preferably, the mixture metal film 230 is deposited by mixing 90% transparent conductive metal powder and 10% conductive metal powder.

In addition, as the conductive metal powder, other metal powder than silver (Ag) metal powder can be also used, and in this case, the transparent conductive metal powder and conductive metal powder are stirred at a mixture ratio that can satisfy the 95% optical transmittance, to form the paste.

Figure 8:
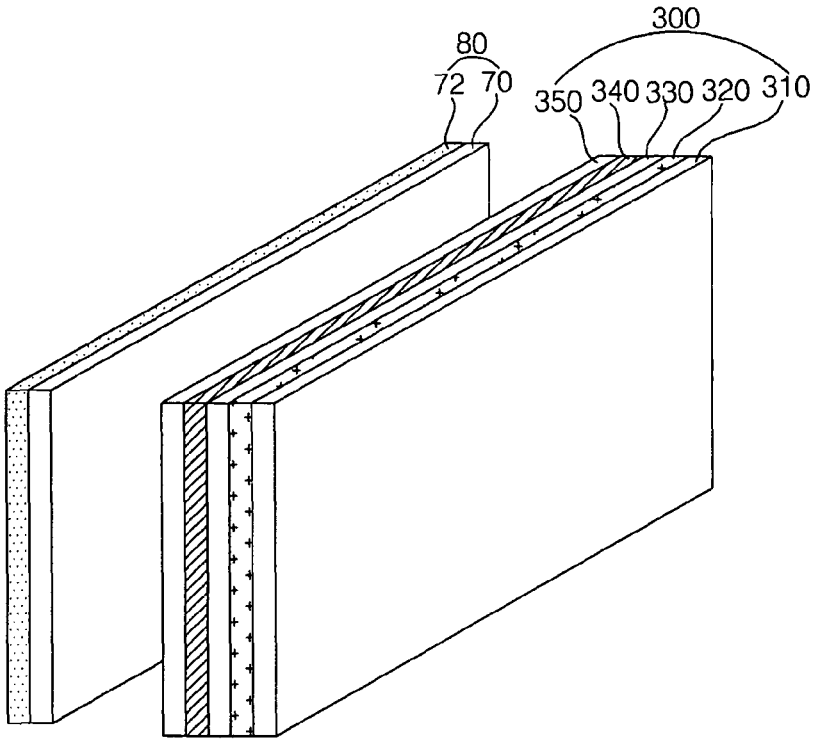
FIG. 8 is a reference view for explaining a PDP in accordance with a third embodiment of the present invention.
Figure 9:
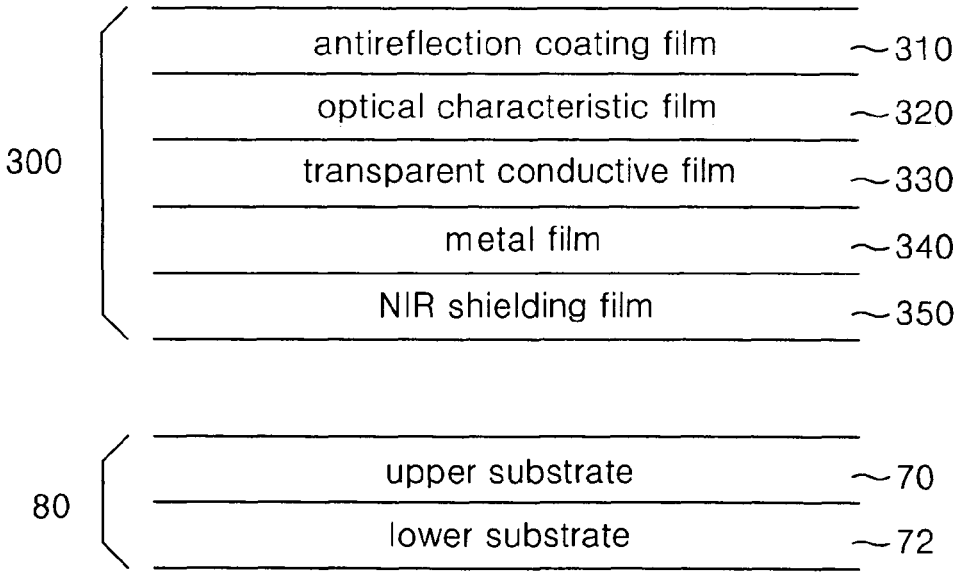
FIG. 9 is a sectional view of a filter in FIG. 8.

FIG. 8 is a perspective view illustrating a panel and a filter coupled with the panel of the PDP in accordance with the third embodiment of the present invention, and FIG. 9 is a sectional view of the filter.

The filter 300 used in the third embodiment of the present invention includes an antireflection coating film 310, a optical characteristic film 320, a transparent conductive film 330, a metal film 340 and a near infrared (NIR) shielding film 350. Compared with the first and second embodiments, in the third embodiment of the present invention, the metal film 340 is additionally formed.

The antireflection coating film 310 provided in the filter 300 prevents light made incident from outside from being reflected, and is formed on a surface of the filter 300. The antireflection coating film 310 can be also formed at a rear surface of the filter 300 additionally.

The optical characteristic film 320 controls color temperature of light emitted from the panel 80 to thereby improve optical characteristics of the PDP.

The transparent conductive film 330 is made of a transparent conductive metal, for example, a metal such as ITO, and prevents emission of electromagnetic waves to outside from the panel 80.

Likewise in the first embodiment, the transparent conductive film 330 can be deposited by alternately coating transparent conductive metal powder and conductive metal powder for compensating resistance of the transparent conductive metal. That is, the transparent conductive film 130 can be formed as a multi-film by alternately stacking a film containing the transparent conductive metal powder and a film containing the metal powder.

Also, likewise as in the second embodiment, the transparent conductive film 330 can be formed as a single film by mixing the transparent conductive metal powder and the conductive metal powder compensating resistance of the transparent conductive metal.

In this case, as the transparent conductive metal powder, the ITO material is used, and as the conductive metal powder, at least one of silver (Ag), copper (Cu), gold (Au) and aluminum (Al) is used.

The ratio of the metal powder is 10% or less than the transparent conductive powder in order to obtain the contrast of the panel.

In order to reduce a voltage drop of the thusly formed transparent conductive film 330, the metal film 340 is stacked on the transparent conductive film 330.

The metal film 340 is made of a conductive metal such as silver (Ag), copper (Cu), gold (Au) and aluminum (Al), and patterned as shown in FIGS. 10*a* to 10*d* in order to improve the optical transmittance of the panel 80.

The NIR shielding film 350 shields the NIR made incident from the panel 80. At this time, at least one of the transparent conductive film 330, the metal film 340 and the NIR shielding film 340 is connected with the back cover to be grounded to thereby shield electromagnetic waves.

Figure 10A:
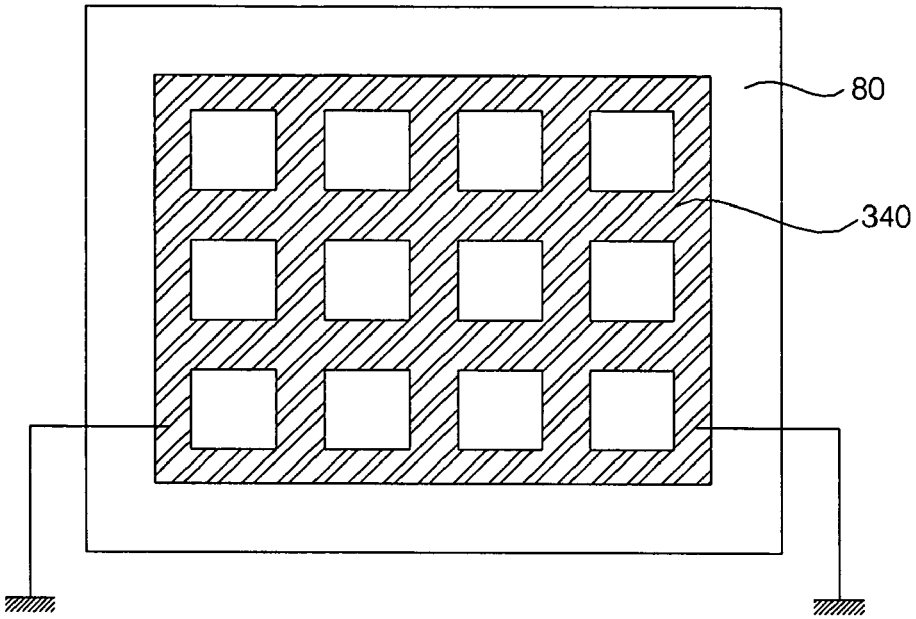
FIGS. 10*a* and 10*d* illustrate patterning of a metal film in accordance with a preferred embodiment of the present invention.
Figure 10B:
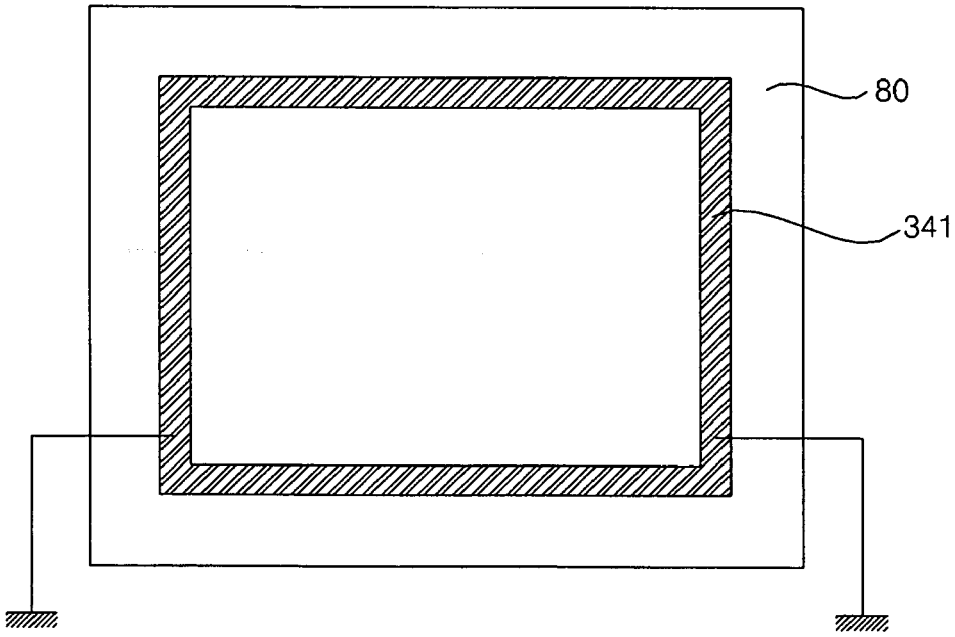
Figure 10C:
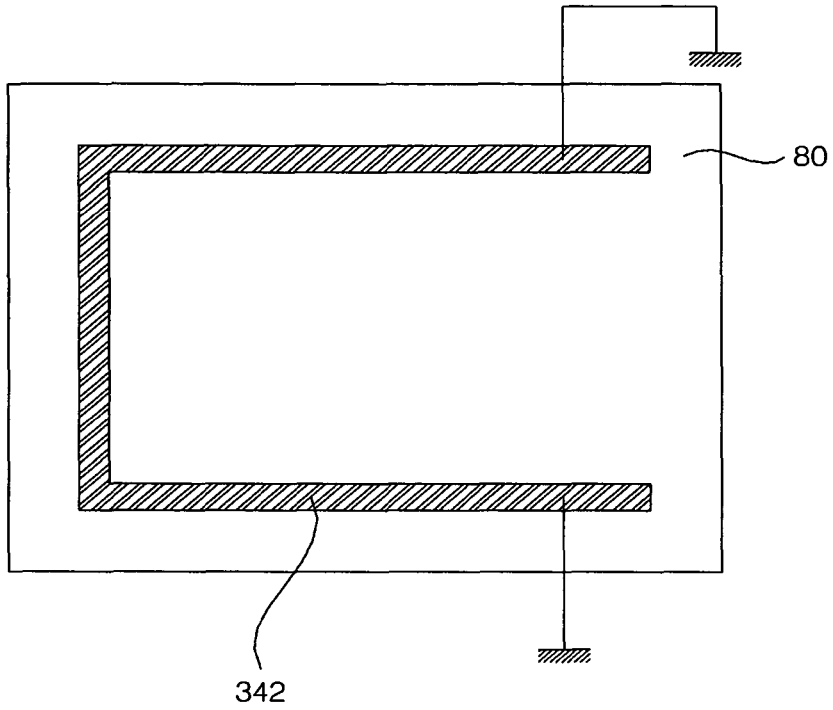
Figure 10D:
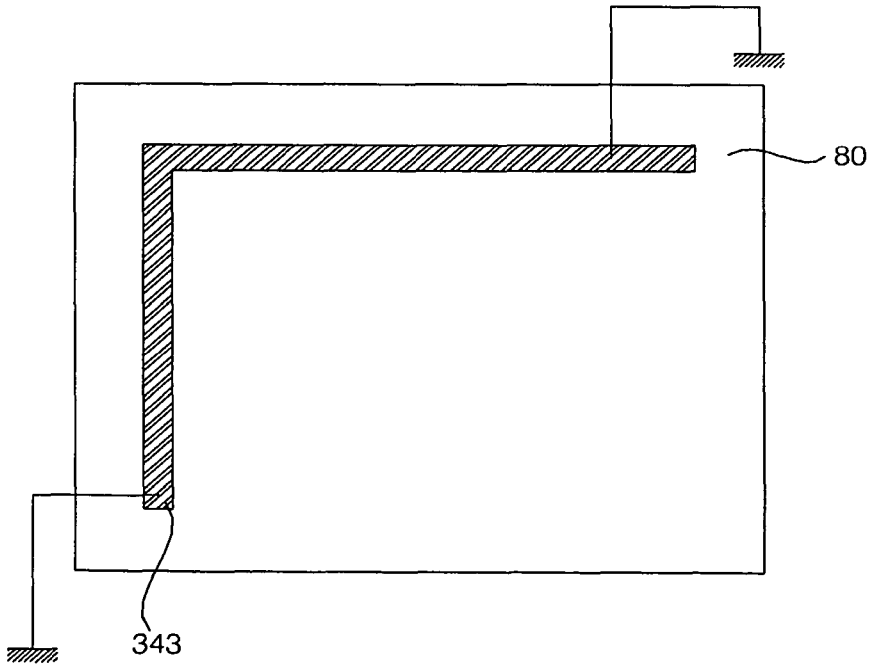

FIGS. 10*a* and 10*d* illustrate patterning of the metal film included in the filter used for the PDP in accordance with the third embodiment of the present invention. The transparent conductive film 330 is uniformly formed on the entire region of the filter 300, and metal films 340~343 are patterned on the transparent conductive film 330 as shown in FIGS. 10*a* to 10*d*.

The metal film 340 as shown in FIG. 10*a* is patterned to overlap with horizontal and vertical barrier ribs separating discharge cells. Because the metal film 340 is patterned in the grid form, overlapping with the barrier ribs, a discharge space of the discharge cell cannot be covered and a voltage drop generated from the transparent conductive film can be minimized. Both ends of the metal film 340 are grounded.

In this case, a horizontal wiring and a vertical wiring that form the metal film 340 may overlap with the horizontal barrier ribs and the vertical ribs separating discharge cells, or may overlap with only horizontal and vertical barrier ribs corresponding to a certain multiple.

With reference to FIG. 10*b*, a metal film 341 is patterned in a hollow-square form and formed at a region where corner portions of the panel 80 are connected. In this case, preferably, the metal film 341 is formed on a non-display region of the panel 80, where an image is not displayed, and the optical transmittance can be better than that of the case as shown in FIG. 10*a*.

Both ends of the metal film 341 are also grounded.

With reference to FIG. 10*c*, the metal film 342 is patterned in a channel shape and formed at a region where corner portions of the panel 80 are connected in the channel shape. Preferably, the metal film 342 is formed on a non-display region of the panel 80, where an image is not displayed, and the optical transmittance can be better than that of the case as shown in FIG. 10*a*.

Both ends of the metal film 342 are grounded and one surface of the panel 80 where the metal film 342 is not formed corresponds to one of upper, lower, left and right sides.

With reference to FIG. 10*d*, a metal film 343 is patterned in an 'L' shape. Three corner portions of the panel 80 are selected, and then, the metal film 343 is formed at a certain region where each corner portion is connected in the 'L' shape. In this case, preferably, the metal film 343 is formed on a non-display region of the panel 80 where an image is not displayed, and the optical transmittance is better than that of the case shown in FIG. 10*a*.

Both ends of the metal film 343 with the longest isolation distance therebetween are grounded and two surface portions of the panel 80 where the metal film 343 is not formed correspond to one of the left and upper sides and the right and lower sides.

As described above, the PDP in accordance with the present invention can have the following effects.

That is, since the filter coupled with the panel is formed as a film type, the panel can be lighter and thinner. In addition, because the transparent conductive film for shielding electromagnetic waves and the metal film staked on the transparent conductive film and preventing the voltage drop generated from the transparent conductive film are additionally provided, electromagnetic waves can be more effectively shielded and the optical transmittance of the filter can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A plasma display panel (PDP) comprising:

a panel; and a film type filter comprised of a transparent conductive film and a metal film formed on the transparent conductive film, and coupled with the panel, wherein the transparent conductive film is formed as a single film in which transparent conductive powder and metal powder are mixed, the metal film is patterned to overlap with at least a part of barrier ribs separating a discharge space of the panel, and is grounded, and a ratio of a content of the metal powder to a content of the transparent conductive powder of the transparent conductive film is less than 10%.

2. The PDP of claim 1, wherein the filter additionally comprises at least one of an antireflection coating film, a optical characteristic film controlling color temperature of light, and a near infrared shielding film stacked on the panel.

3. The PDP of claim 1, wherein the metal film is further formed on a non-display region of the panel.

4. The PDP of claim 1, wherein the metal film is further formed in a bar type at least one side of the non-display region of the panel.

5. The PDP of claim 1, wherein the metal film is further formed at the peripheral on the non-display region of the panel.

6. The PDP of claim 1, wherein the metal film is connected with a ground terminal of the panel.

* * * * *